US012209319B2

(12) United States Patent
McWaid et al.

(10) Patent No.: US 12,209,319 B2
(45) **Date of Patent: *Jan. 28, 2025**

(54) ANODE AND/OR CATHODE PAN ASSEMBLIES IN AN ELECTROCHEMICAL CELL, AND METHODS TO USE AND MANUFACTURE THEREOF

(71) Applicant: Verdagy, Inc., Moss Landing, CA (US)

(72) Inventors: Thomas H. McWaid, Santa Cruz, CA (US); Ryan J. Gilliam, San Jose, CA (US)

(73) Assignee: Verdagy, Inc., Moss Landing, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/821,642

(22) Filed: Aug. 23, 2022

(65) Prior Publication Data

US 2023/0212764 A1 Jul. 6, 2023

Related U.S. Application Data

(63) Continuation of application No. 17/807,295, filed on Jun. 16, 2022, now abandoned, which is a continuation of application No. 17/557,467, filed on Dec. 21, 2021, now Pat. No. 11,390,956.

(60) Provisional application No. 63/195,531, filed on Jun. 1, 2021.

(51) Int. Cl.

| | |
|---|---|
| ***C25B 11/02*** | (2021.01) |
| ***C25B 1/02*** | (2006.01) |
| ***C25B 9/19*** | (2021.01) |
| ***C25B 13/00*** | (2006.01) |
| ***C25B 15/08*** | (2006.01) |

(52) U.S. Cl.
CPC ..... *C25B 11/02* (2013.01); *C25B 1/02* (2013.01); *C25B 9/19* (2021.01); *C25B 13/00* (2013.01); *C25B 15/08* (2013.01)

(58) Field of Classification Search
CPC ..... C25B 11/02; C25B 11/03; B25B 11/02
See application file for complete search history.

(56) References Cited

U.S. PATENT DOCUMENTS

| | | | |
|---|---|---|---|
| 3,853,738 | A | 12/1974 | Loftfield et al. |
| 4,057,675 | A | 11/1977 | Halberstadt et al. |
| 4,519,888 | A | 5/1985 | Akazawa et al. |

(Continued)

FOREIGN PATENT DOCUMENTS

| | | |
|---|---|---|
| CN | 117460864 | 1/2024 |
| EP | 1580303 A2 | 9/2005 |

(Continued)

OTHER PUBLICATIONS

"U.S. Appl. No. 17/557,467, Examiner Interview Summary mailed Apr. 25, 2022", 2 pgs.

(Continued)

*Primary Examiner* — Brian W Cohen
(74) *Attorney, Agent, or Firm* — Schwegman Lundberg & Woessner, P.A.

(57) ABSTRACT

Provided herein, are anode and/or cathode pan assemblies comprising unique ribs and welds configurations; electrochemical cell and/or electrolyzer containing the anode and/or the cathode pan assemblies; and methods to use and manufacture the same.

29 Claims, 6 Drawing Sheets

(56) References Cited

U.S. PATENT DOCUMENTS

| | | | | |
|---|---|---|---|---|
| 4,734,180 | A * | 3/1988 | Sato | C25B 9/77 204/279 |
| 4,923,583 | A | 5/1990 | Woodard, Jr. et al. | |
| 4,988,581 | A | 1/1991 | Wycliffe | |
| 5,100,525 | A * | 3/1992 | Pohto | C25B 11/02 204/288.3 |
| 5,705,051 | A * | 1/1998 | Coin | B01D 53/1425 205/770 |
| 5,958,211 | A * | 9/1999 | Traini | C25B 11/03 205/625 |
| 7,381,313 | B2 | 6/2008 | Libby et al. | |
| 8,636,880 | B2 | 1/2014 | Stolberg | |
| 9,340,882 | B2 | 5/2016 | Tampucci et al. | |
| 10,407,781 | B2 | 9/2019 | Domon et al. | |
| 10,883,181 | B2 | 1/2021 | Takanami et al. | |
| 10,968,526 | B2 | 4/2021 | Iacopetti et al. | |
| 11,390,956 | B1 | 7/2022 | McWaid et al. | |
| 2016/0090657 | A1 | 3/2016 | Nigel | |
| 2022/0025525 | A1 | 1/2022 | Wada | |

FOREIGN PATENT DOCUMENTS

| | | | | |
|---|---|---|---|---|
| WO | WO-2017100845 | A1 * | 6/2017 | C25B 1/04 |
| WO | 2022256043 | | 12/2022 | |

OTHER PUBLICATIONS

"U.S. Appl. No. 17/557,467, Non Final Office Action mailed Mar. 3, 2022", 7 pgs.
"U.S. Appl. No. 17/557,467, Notice of Allowance mailed Jun. 3, 2022", 7 pgs.
"U.S. Appl. No. 17/557,467, Response filed May 16, 2022 to Non Final Office Action mailed Mar. 3, 2022", 13 pgs.
"Diffusion bonding", [Online] Retrieved from the internet: <https://en.wikipedia.org/wiki/Diffusion_bonding>, (Nov. 16, 2021).
"International Application Serial No. PCT/US2021/065005, International Search Report mailed Mar. 9, 2022", 3 pgs.
"International Application Serial No. PCT/US2021/065005, Written Opinion mailed Mar. 9, 2022", 7 pgs.
Gilliamryan, J., et al., "Co-pending U.S. Appl. No. 17/560,706, filed Dec. 23, 2021".
Mandhane, J M, et al., "A flow pattern map for gas-liquid flow in horizontal pipes", International Journal of Multiphase Flow, (1974), 537-553.
McWaidthomas, H, et al., "Co-pending U.S. Appl. No. 17/557,421, filed Dec. 21, 2021".
"International Application Serial No. PCT US2021 065005, International Preliminary Report on Patentability mailed Dec. 14, 2023", 9 pgs.
"Japanese Application Serial No. 2023-574158, Voluntary Amendment filed Jan. 29, 2024", w English claims, 9 pgs.

* cited by examiner

ANODE AND/OR CATHODE PAN ASSEMBLIES IN AN ELECTROCHEMICAL CELL, AND METHODS TO USE AND MANUFACTURE THEREOF

CROSS-REFERENCE TO RELATED APPLICATIONS

This application is a continuation of and claims the benefit of priority of U.S. application Ser. No. 17/807,295, filed Jun. 16, 2022, which is a continuation of and claims the benefit of priority of U.S. application Ser. No. 17/557,467, filed Dec. 21, 2021, which claims benefit of U.S. Provisional Application No. 63/195,531, filed Jun. 1, 2021, each of which is incorporated herein by reference in its entirety in the present disclosure.

BACKGROUND

Production of hydrogen plays a key role in any industrialized society, since hydrogen is required for many essential chemical processes. As of 2019, roughly 70 million tons of hydrogen may have been produced annually worldwide for various uses, such as oil refining, and in the production of ammonia (through the Haber process) and methanol (through reduction of carbon monoxide), and also as a fuel in transportation.

A majority of hydrogen (~95%) may be produced from fossil fuels by steam reforming of natural gas, partial oxidation of methane, and coal gasification. Other methods of hydrogen production include biomass gasification, no $CO_2$ emissions methane pyrolysis, and electrolysis of water. Electrolysis consists of using electricity to split water into hydrogen and oxygen. All methods and systems are, however, generally more expensive than fossil-fuel based production methods and the fossil-fuel based methods are environmentally damaging. Therefore, there is a need for a cost competitive and an environmentally friendly hydrogen gas producing electrolysis system.

SUMMARY

Provided herein are methods and systems that relate to anode pan assembly and/or cathode pan assembly configurations used in electrochemical cells designed to carry out electrolysis processes, such as, e.g. hydrogen gas production in an ion exchange membrane (IEM) water electrolysis technology that may enable commercially compelling alternative to fossil fuels. The anode pan assembly and/or cathode pan assembly configurations provided herein include unique ribs and welds configurations that enable operation of the electrochemical cells at high current densities. Due to production at high current densities, a targeted production rate may be met with fewer cells, thereby reducing capital expenses and making electrolysis system a viable source for hydrogen gas production.

In one aspect, there is provided an anode and/or a cathode pan assembly, comprising: an anode and/or a cathode pan; one or more ribs wherein the one or more ribs are positioned vertically inside the anode and/or the cathode pan; an electrode welded to the one or more ribs; and one or more welds that weld the electrode to the one or more ribs.

In some embodiments of the foregoing aspect, number of the one or more ribs inside the anode and/or the cathode pan is between about 1-75. In some embodiments of the foregoing aspect and embodiment, thickness of the one or more ribs is between about 1-3 mm. In some embodiments of the foregoing aspects and embodiments, height of the one or more ribs is between about 10-110 mm. In some embodiments of the foregoing aspects and embodiments, pitch between two or more ribs is between about 40-200 mm. In some embodiments of the foregoing aspects and embodiments, each of the one or more ribs comprises one or more notches and one or more ridges.

In some embodiments of the foregoing aspects and embodiments, the electrode is a planar electrode or an expanded metal or a mesh. In some embodiments of the foregoing aspects and embodiments, each strand of the expanded metal or the mesh electrode has a thickness of between about 0.5-3 mm.

In some embodiments of the foregoing aspects and embodiments, the one or more welds are in form of lines, spots, pattern, or combinations thereof. In some embodiments of the foregoing aspects and embodiments, number of the one or more welds per rib that are in the form of the spots is between about 10-50 welds per rib. In some embodiments of the foregoing aspects and embodiments, distance between each of the welds when two or more welds are in the form of the spots is between about 25-200 mm independently in x- and y-directions. In some embodiments of the foregoing aspects and embodiments, number of the one or more welds per rib that are in the form of the lines is between about 1-75 welds per rib. In some embodiments of the foregoing aspects and embodiments, distance between each of the welds when two or more welds are in the form of the lines is between about 40-200 mm independently in x- and y-directions. In some embodiments of the foregoing aspects and embodiments, the pattern is selected from the group consisting of dots, an array of dots, dashes, spots, line segments, long lines, oval geometry, rectangular geometry, circular geometry, hexagonal geometry, and combinations thereof.

In some embodiments of the foregoing aspects and embodiments, cross sectional area of each weld is between about 6 $mm^2$-3300 $mm^2$. In some embodiments of the foregoing aspects and embodiments, ratio of electrode area to weld area is in range of 15× to 2000×. In some embodiments of the foregoing aspects and embodiments, the current density through each weld is less than 6 $A/mm^2$.

In some embodiments of the foregoing aspects and embodiments, the anode and/or the cathode pan assembly comprises a high flow rate of anolyte or catholyte, respectively, of between about 200-10,000 kg/h. In some embodiments of the foregoing aspects and embodiments, the anode and/or the cathode pan assembly is inside an electrochemical cell running at high current densities of between about 300 $mA/cm^2$-6000 $mA/cm^2$.

In some embodiments of the foregoing aspects and embodiments, the thickness of the one or more ribs, the height of the one or more ribs, the pitch between the one or more ribs, the number of the welds per rib, the distance between each weld, the cross sectional area of each weld, and/or ratio of electrode area to weld area minimize the impact of high and potentially fluctuating power dissipation rates on the internal temperature of the cell, and prevent membrane damage due to high local temperatures, mechanical erosion and/or fatigue.

In some embodiments of the foregoing aspects and embodiments, the anode and/or the cathode pan assembly is inside a hydrogen gas producing electrochemical cell. In some embodiments, hydrogen is generated at the cathode and oxygen is generated at the anode in the hydrogen gas producing electrochemical cell.

In some embodiments of the foregoing aspects and embodiments, the anode and/or the cathode pan assembly further comprises an electrolyte, such as an anolyte and/or a catholyte, respectively, wherein the anolyte and/or the catholyte comprise an alkaline solution.

In one aspect, there is provided an electrochemical cell, comprising: the anode and/or the cathode pan assembly of any of the aforementioned aspects and embodiments; and an ion exchange membrane disposed between the anode and the cathode. It is to be understood that in the electrochemical cell, either the aforementioned anode pan assembly (with a regular or conventional cathode pan assembly comprising a cathode pan and a cathode) or the aforementioned cathode pan assembly (with a regular or conventional anode pan assembly comprising an anode pan and an anode) or both the anode pan assembly and the cathode pan assembly may be present and as such all of those configurations are well within the scope of this disclosure.

In one aspect, there is provided an electrolyzer comprising multiplicity of individual aforementioned electrochemical cells.

In one aspect, there is provided a method, comprising: positioning one or more ribs vertically inside an anode and/or a cathode pan of an electrochemical cell; positioning an electrode on top of the one or more ribs; and welding the electrode to the one or more ribs through one or more welds.

In some embodiments of the foregoing aspect, the method further comprises placing the electrode perpendicularly to the one or more ribs. In some embodiments of the foregoing aspect and embodiments, the method further comprises positioning between 1-75 ribs vertically inside the anode and/or the cathode pan of the electrochemical cell. In some embodiments of the foregoing aspect and embodiments, the method further comprises providing thickness of the one or more ribs to be between about 1-3 mm; height of the one or more ribs to be between about 10-110 mm; and/or pitch between two or more ribs to be between about 40-200 mm. In some embodiments of the foregoing aspect and embodiments, each of the one or more ribs comprises one or more notches and one or more ridges. In some embodiments of the foregoing aspect and embodiments, the electrode is a planar electrode or an expanded metal or a mesh. In some embodiments of the foregoing aspect and embodiments, the method further comprises providing each strand of the expanded metal or the mesh electrode having a thickness of between about 0.5-3 mm.

In some embodiments of the foregoing aspect and embodiments, the method further comprises providing the one or more welds in form of lines, spots, pattern, or combinations thereof. In some embodiments of the foregoing aspect and embodiments, the method further comprises providing number of the one or more welds per rib that are in the form of the spots to be between about 10-50 welds per rib. In some embodiments of the foregoing aspect and embodiments, the method further comprises providing distance between each of the welds when two or more welds are in the form of the spots to be between about 25-200 mm independently in x- and y-directions. In some embodiments of the foregoing aspect and embodiments, the method further comprises providing number of the one or more welds per rib that are in the form of the lines is between about 1-75 welds per rib. In some embodiments of the foregoing aspect and embodiments, the method further comprises providing distance between each of the welds when two or more welds are in the form of the lines to be between about 40-200 mm independently in x- and y-directions. In some embodiments of the foregoing aspect and embodiments, the method further comprises providing cross sectional area of each weld to be between about 6 $mm^2$-3300 $mm^2$. In some embodiments of the foregoing aspect and embodiments, the method further comprises providing ratio of electrode area to weld area in range of 15× to 2000×.

In some embodiments of the foregoing aspects and embodiments, the method further comprises operating the anode and/or the cathode pan assembly under a high flow rate of anolyte or catholyte, respectively, of between about 200-10,000 kg/h. In some embodiments of the foregoing aspects and embodiments, the method further comprises positioning the anode and/or the cathode pan assembly to assemble an electrochemical cell and running the electrochemical cell at high current densities of between about 300 $mA/cm^2$-6000 $mA/cm^2$. In some embodiments of the foregoing aspects and embodiments, the electrochemical cell is hydrogen gas producing cell.

In some embodiments of the foregoing aspects and embodiments, the method further comprises minimizing impact of fluctuating power dissipation on internal temperature of the cell. In some embodiments of the foregoing aspects and embodiments, the method further comprises preventing membrane damage due to high local temperatures, mechanical erosion and/or fatigue.

In one aspect, there is provided a process for manufacturing an anode and/or a cathode pan assembly, comprising: positioning one or more ribs vertically inside an anode and/or a cathode pan of an electrochemical cell; positioning an electrode on top of the one or more ribs; and welding the electrode to the one or more ribs through one or more welds. In some embodiments of the foregoing aspect, the process comprising metallurgically attaching the one or more ribs inside the anode and/or the cathode pan of the electrochemical cell.

In one aspect, there is provided a process for assembling an electrochemical cell, comprising:

- assembling an individual electrochemical cell by joining together the aforementioned anode pan assembly with a cathode pan assembly comprising a cathode pan and a cathode; or
- assembling an individual electrochemical cell by joining together the aforementioned cathode pan assembly with an anode pan assembly comprising an anode pan and an anode; or
- assembling an individual electrochemical cell by joining together the aforementioned anode pan assembly and the aforementioned cathode pan assembly;
- placing the anode pan assembly and the cathode pan assembly in parallel and separating them by an ion-exchange membrane; and
- supplying the electrochemical cell with feeders for a cell current and an electrolysis feedstock.

In some embodiments of the aforementioned aspect, the electrochemical cell is hydrogen gas producing cell.

In one aspect, there is provided a process for assembling an electrolyzer, comprising: assembling aforementioned individual electrochemical cells; and placing a plurality of the assembled electrochemical cells side by side in a stack and bracing them together so as to sustain electrical contact between the electrochemical cells.

BRIEF DESCRIPTION OF THE DRAWINGS

The novel features of the invention are set forth with particularity in the appended claims. A better understanding of the features and advantages of the present invention may be obtained by reference to the following detailed description that sets forth illustrative embodiments, in which the principles of the invention are utilized, and the accompanying drawings of which:

DETAILED DESCRIPTION

Figure 1:
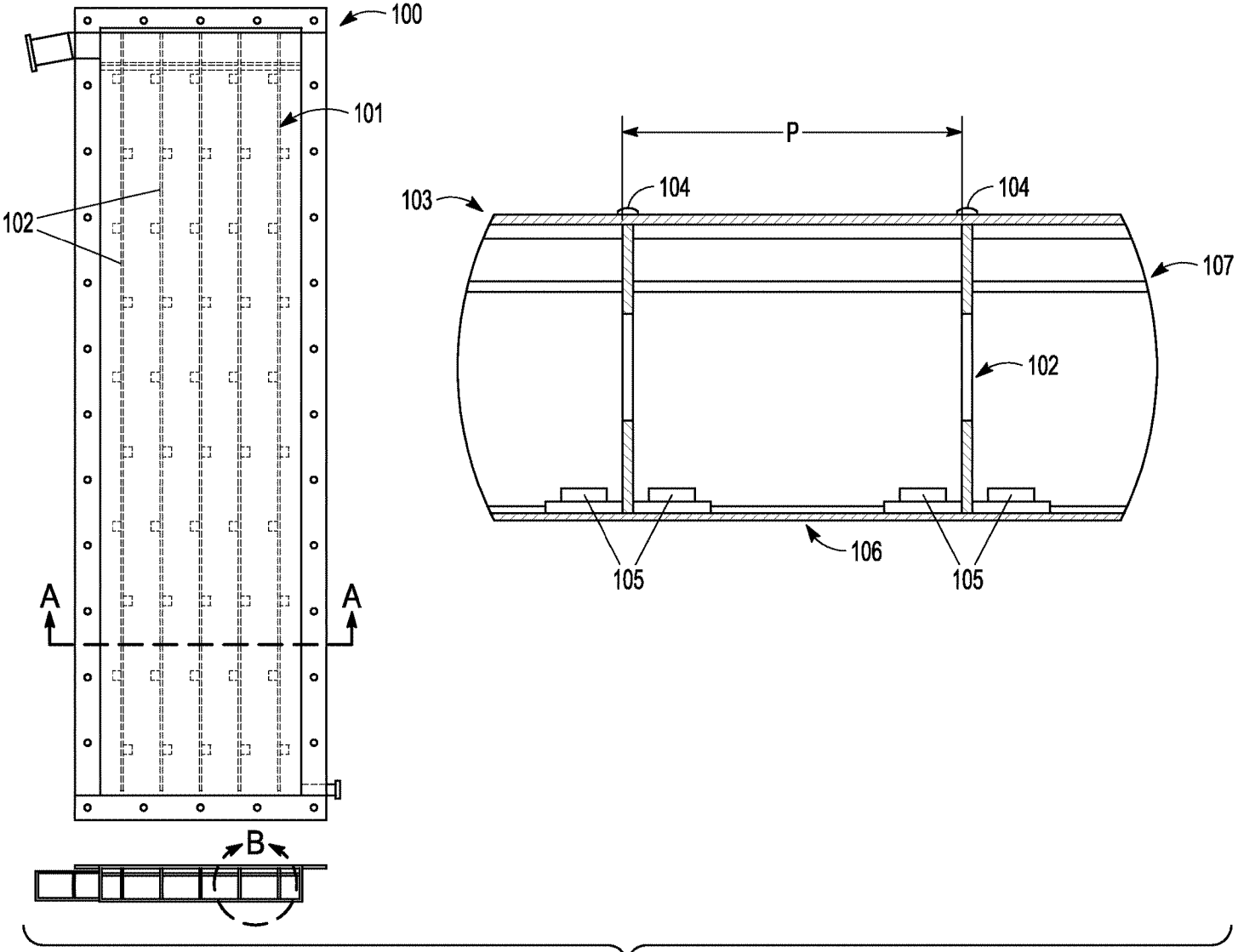
FIG. 1 illustrates some embodiments related to the anode pan assembly or the cathode pan assembly comprising one or more ribs, an electrode and one or more welds welding the electrode to the ribs. The figure on the left illustrates a front view of the assembly and figure on the right illustrates a cross section of the side view of the assembly.

Provided herein, are components, methods, and electrochemical cells that relate to the anode pan assembly and/or the cathode pan assembly comprising unique ribs and welds configurations, designed to carry out electrolysis processes, such as e.g. hydrogen gas production at high current densities in IEM, such as e.g. anion exchange membrane (AEM) alkaline water electrolysis technology.

Typically, commercial alkaline water electrolysis cells may operate at 100-400 $mA/cm^2$. For example, commercial chlor-alkali electrochemical cells typically may operate at current densities of up to about 500 $mA/cm^2$. However, Applicants have designed unique electrochemical cells and its components that can dynamically operate at high current densities so that operators may meet their targeted production rate with fewer cells, thereby reducing capital expenses. Moreover, the cell's high range of operational current densities may provide operators with a large turndown ratio, enabling them to maximize production when power prices are low, and reduce power consumption when power prices are high.

Before the present invention is described in greater detail, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits, ranges excluding either or both of those included limits are also included in the invention.

Certain ranges that are presented herein with numerical values may be construed as "about" numericals. The "about" is to provide literal support for the exact number that it precedes, as well as a number that is near to or approximately the number that the term precedes. In determining whether a number is near to or approximately a specifically recited number, the near or approximating unrequited number may be a number, which, in the context in which it is presented, provides the substantial equivalent of the specifically recited number.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, representative illustrative methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It is noted that, as used herein and in the appended claims, the singular forms "a," "an," and "the" include plural references unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. Any recited method can be carried out in the order of events recited or in any other order which is logically possible.

Anode and/or Cathode Pan Assembly

The operation of the electrochemical cells at high current densities, as stated earlier, can result in significant challenges, such as, but not limited to, large amount of heat generated in the cell, significant temperature and pressure fluctuations, membrane erosion or fatigue, and/or high flow rates of the electrolytes to combat Joule heating due to current flow.

In the electrochemical cells producing large amount of gas at high current densities, the gas/liquid mixture may have a lower specific heat, a lower density and/or a lower thermal conductivity than the liquid electrolyte. The heat removal efficiency may be reduced as the gas hold up increases. Local temperatures may potentially rise quickly if a gas pocket masks a region of the electrode. If a significant region of the electrode is masked, the unmasked region may have to work harder, increasing the local Joule heating. Local hot spots thus developed can damage the membrane. As the current density is increased in the cell, power dissipation may also rise dramatically. Large spatial and/or temporal temperature fluctuations can damage the membrane. The contribution of the internal power dissipation to the cell's internal temperature distribution may be minimized through use of Applicant's rib geometry and/or spacing, and/or weld density and cross-sectional configurations in the anode and/or cathode pan assemblies in the electrochemical cells.

The unique rib geometry and/or spacing, and/or weld density and cross-sectional configurations in the anode and/or cathode pan assemblies in the electrochemical cells provided herein can overcome one or more of these challenges, such as, but not limited to, distribute current across cell area to avoid hot spots, avoid large spatial and/or temporal temperature fluctuations of the electrolyte along the height of the cell, and/or avoid membrane damage due to hot spots.

While the design of the anode and/or cathode pan assembly comprising the one or more ribs and the welds as provided herein, insures that there is efficient current distribution across the active area with the operation at high current densities; the cross sectional area of the ribs and the welds also ensures cells that are effective for operational and economical purposes.

In a typical electrochemical cell, there is an anode pan that houses an anode and an anode electrolyte. There is a cathode pan that houses a cathode and a cathode electrolyte and the anode pan and the cathode pan are separated by one or more diaphragm, a membrane electrode assembly (MEA) or an ion exchange membrane (IEM). The anode pan and/or the cathode pan may further comprise components, such as a collection system (such as manifold and/or outlet tube described in US Provisional application filed on even date herewith, titled, "Anode and/or cathode pan assemblies in an electrochemical cell, and methods to use and manufacture thereof" which is incorporated herein by reference in its entirety) that collects the gas and the liquid and flow them out of the cell.

The IEM may be an anion exchange membrane (AEM), a cation exchange membrane (CEM), or both depending on the desired reactions at the anode and the cathode. In between these components, various additional separator components may be provided to separate, e.g. the AEM from the anode, the CEM from the cathode and/or AEM from the CEM as well as provide mechanical integrity to the membranes. In addition to these components, individual gaskets or gasket tape may be provided in between and along the outer perimeter of the components to seal the compartments from fluid leakage.

All the components described above may be aligned parallel to each other and optional peripheral bolting may be provided to stack them together in the electrochemical cell. In filter press configuration, no peripheral bolting may be required. In a stack of electrochemical cells, the anode of one electrochemical cell is in contact with the cathode of the adjacent electrochemical cell. The current passes through the stack of electrochemical cells during operation.

Provided herein, are the anode and/or the cathode pan assemblies comprising the unique ribs and welds configurations and the electrochemical cells containing the same. In one aspect, provided herein are the anode and/or the cathode pan assembly, the methods to form, use and manufacture thereof, comprising: an anode and/or a cathode pan, one or more ribs wherein the one or more ribs are positioned vertically inside the anode and/or the cathode pan; an electrode welded to the one or more ribs; and one or more welds that weld the electrode to the one or more ribs.

In an illustrative embodiment, the anode pan assembly or the cathode pan assembly of the invention is shown in FIG. 1 (figure on the left top illustrates a front view of the assembly; figure on the left bottom is a side view of the assembly; and figure on the right illustrates an enlarged cross section view of the side view of the assembly). It is to be understood that in the electrochemical cell, either the anode pan assembly as provided herein or the cathode pan assembly as provided herein or both may be used. For example, the assembly shown in FIG. 1 can be the anode pan assembly or the cathode pan assembly or both depending on the need and the reaction at the anode and the cathode.

As illustrated in FIG. 1, the anode pan assembly or the cathode pan assembly 100 comprises an anode pan or a cathode pan 101, respectively. Inside the depth of the anode pan or the cathode pan (shown in the left figure) is housed one or more ribs 102. The figure on the right illustrates an enlarged cross section view of the side view of the anode pan assembly or the cathode pan assembly 100. The enlarged side view shows the stacking of the components comprising the one or more ribs 102. The one or more ribs 102 are perpendicular to the anode or the cathode pan 101. On top of the anode or the cathode pan 101 and on top of the one or more ribs 102, is placed an electrode 103 (an anode for the anode pan assembly and cathode for the cathode pan assembly). The electrode 103 is welded to the one or more ribs 102 through one or more welds 104. The ribs are attached to the floor of the anode or the cathode pan 106 through tabs 105.

During the operation of the cell, the current flows into the cathode through the welds; it then flows from the cathode to the one or more ribs. The current then flows through the one or more ribs to the cathode pan through the tabs and finally into a conductor contacting the pan (adjacent half-cell pan or contact plate). The current then flows from the tabs to the anode pan, through the ribs and then to the anode and the welds. The one or more ribs 102 are welded to the pan floor 106 through tabs 105. The tabs 105 may set the spacing of the welds between the bottom of the ribs 102 and the pan floor 106. Since the current flows from the pan floor through the ribs and then across the anode, the tabs 105 provide adequate weld cross-section between the ribs and the pan. The tabs 105 facilitate better current distribution across the active area and provide electrical contact between the ribs and the pan. However, in some embodiments, the ribs may directly be welded to the pan floor and may not be connected through the tabs.

The geometry and spacing of the one or more ribs can dictate current flow through the half-cell. The geometry of the ribs include, but not limited to, number of the ribs, height of the ribs, design of the ribs, pitch between the two ribs, and/or thickness of the ribs. As the current flows in through the welds, the geometry, spacing or density, and/or cross sectional area of the welds can also impact current flow through the half-cell. As the increasingly high currents flow through the cell, the density and the cross sectional area of the welds can significantly impact the local Joule heating and avoid membrane damage from local hot spots. Provided herein are the unique geometry, spacing, and cross sectional area of the ribs as well as the welds that facilitate efficient operation of the electrochemical cells at high current densities.

In some embodiments, the one or more ribs provided herein can be solid plates made of conductive metal. In some embodiments, the one or more ribs provided herein have holes or openings for the electrolyte to move laterally. In some embodiments, the one or more ribs provided herein have one or more notches (as described further herein). In some embodiments, the one or more ribs provided herein have both the holes as well as the notches.

In some embodiments, the geometry of the ribs includes the number of ribs in the anode and/or the cathode pan. In some embodiments, the number of the one or more ribs inside the anode and/or the cathode pan can impact the current distribution and the power dissipation. In some embodiments, the number of the one or more ribs inside the anode and/or the cathode pan is between about 1-75; or between about 1-60; or between about 1-50; or between about 1-40; or between about 1-30; or between about 1-20; or between about 1-10; or between about 1-5; or between about 5-75; or between about 5-60; or between about 5-50; or between about 5-40; or between about 5-30; or between about 5-20; or between about 5-10; or between about 10-75; or between about 10-60; or between about 10-50; or between about 10-40; or between about 10-30; or between about 10-20; or between about 20-75; or between about 20-60; or between about 20-50; or between about 20-40; or between about 20-30; or between about 30-75; or between about 30-60; or between about 30-50; or between about 30-40; or between about 40-75; or between about 40-60; or between about 40-50; or between about 50-75; or between about 50-60; or between about 60-75. For example, FIG. 1 illustrates the anode or the cathode pan 101 containing 5 ribs 102. In some embodiments, the number of the one or more ribs inside the anode and/or the cathode pan is between about 5-30; or between about 10-20.

Figure 2:
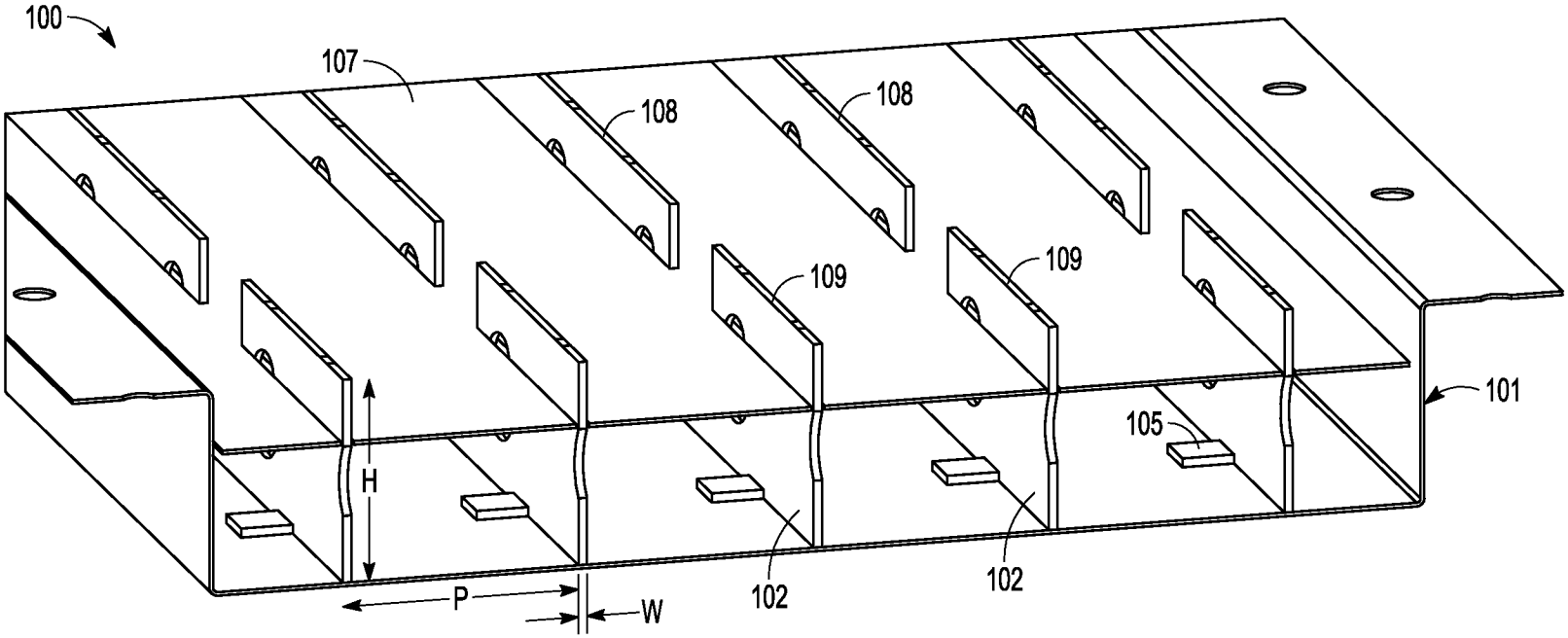
FIG. 2 illustrates some embodiments related to a cross-sectional and an enlarged view of the one or more ribs inside the anode pan or the cathode pan.

A cross-sectional and enlarged view of the one or more ribs inside the anode or the cathode pan is shown in FIG. 2. The electrode and the welds are not being shown in this figure. The anode and/or the cathode pan assembly 100 comprise the anode and/or the cathode pan 101 which has ribs 102 positioned vertically in the pan. The ribs 102 are welded to the floor of the pan through tabs 105. The pitch or the distance between the two ribs 102 is marked as P; the height of the one or more ribs is marked as H; and the thickness or the width of the one or more ribs is marked as W. The ribs are illustrated in FIG. 2 as comprising holes for the movement of the electrolyte as well as notches 108 and ridges 109. The notches 108 and the ridges 109 facilitate fitting of the baffle plate 107 over the one or more ribs 102. The baffle plate described in US Provisional application filed on even date herewith, titled, "Anode and/or cathode pan assemblies in an electrochemical cell, and methods to use and manufacture thereof" is incorporated herein by reference in its entirety. The one or more ribs may be made of any conductive metal, such as, but not limited to, nickel, stainless steel, etc.

It is to be understood that the holes and the notches (and ridges) on the ribs may not be present and the ribs may be a solid plate of conductive metal or the ribs may have holes and not have notches or the ribs may have notches but not have holes. All such configurations are well within the scope of the invention. The holes, if present, may not be of any specific shape or size. For example, the holes may be circular, slits, perforations or a mesh.

Figure 3B:
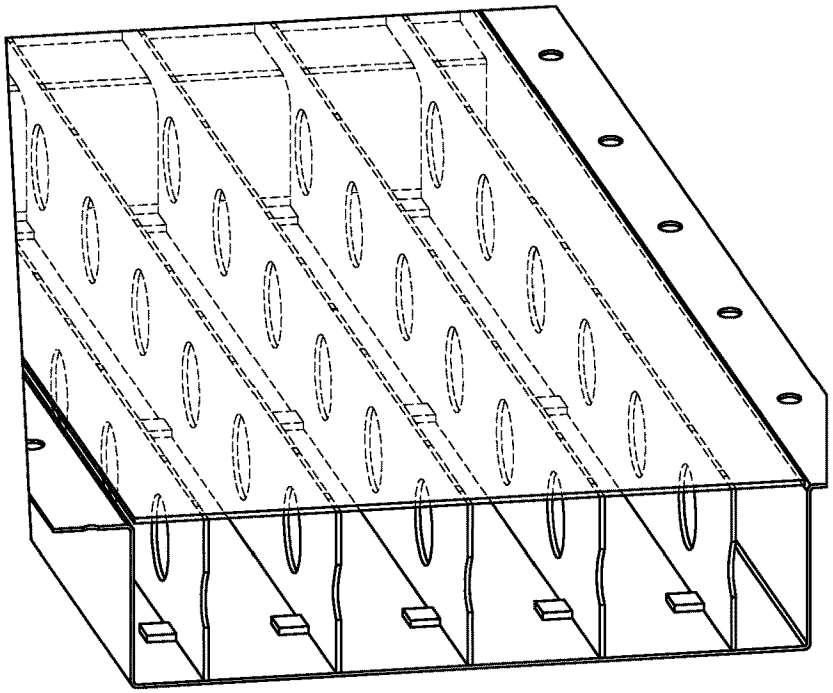
FIGS. 3A and 3B illustrate some embodiments related to a cross-sectional and an enlarged view of the one or more ribs inside the anode pan or the cathode pan.
Figure 3A:
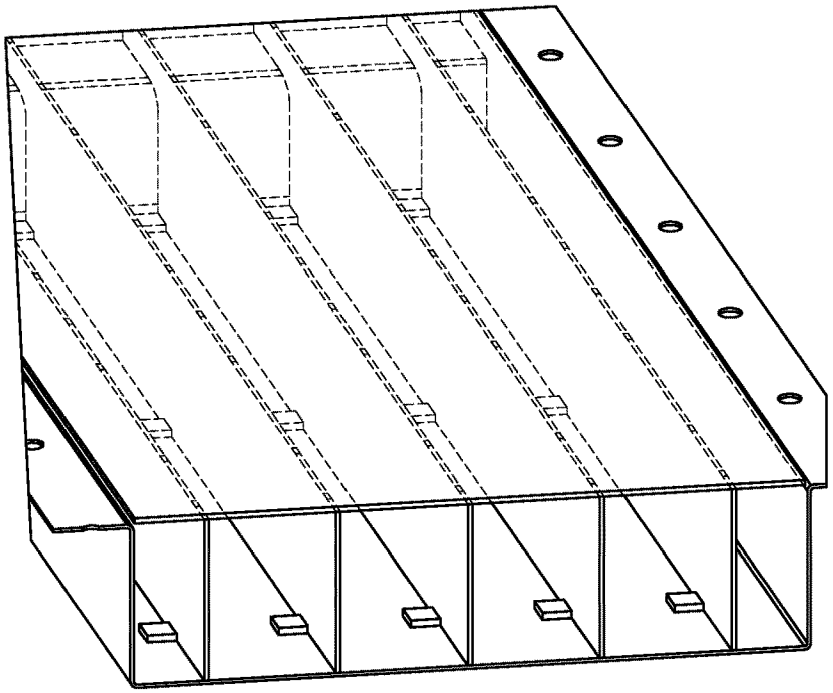

An illustration of the aforementioned embodiments is shown in FIGS. 3A and 3B. FIG. 3A illustrates the anode and/or the cathode assembly with the ribs as a solid plate (no holes or notches and no baffle plate). FIG. 3B illustrates the anode and/or the cathode assembly with the ribs having holes but no notches (no baffle plate).

If notches 108 and ridges 109 are present in the one or more ribs 102, the length of the ridge is between about 0.25-1.0 m; or between about 0.25-0.8 m; or between about 0.25-0.6 m; or between about 0.25-0.5 m; or between about 0.25-0.4 m; or between about 0.25-0.3 m; or between about 0.5-1.0 m; or between about 0.5-0.8 m; or between about 0.5-0.6 m; or between about 0.6-1.0 m; or between about 0.6-0.8 m; or between about 0.7-1.0 m; or between about 0.7-0.8 m; or between about 0.8-1.0 m. In some embodiments, the length of the notch in the ribs is between about 5-100 mm; or between about 5-80 mm; or between about 5-60 mm; or between about 5-50 mm; or between about 5-40 mm; or between about 5-30 mm; or between about 5-20 mm; or between about 5-10 mm; or between about 10-100 mm; or between about 10-50 mm; or between about 10-40 mm; or between about 10-30 mm; or between about 10-20 mm; or between about 20-100 mm; or between about 20-50 mm; or between about 20-40 mm; or between about 20-30 mm; or between about 30-100 mm; or between about 30-50 mm; or between about 30-40 mm; or between about 40-100 mm; or between about 40-50 mm; or between about 50-100 mm; or between about 75-100 mm.

In some embodiments, the geometry of the ribs further includes the height H of ribs, the pitch P between the ribs, and the thickness or the width of the ribs W in the anode and/or the cathode pan. In some embodiments, the geometry of the ribs including the height, the pitch, and the thickness can impact the current distribution and the power dissipation.

In some embodiments, in the anode and/or the cathode pan assembly the thickness of the one or more ribs (W in FIG. 2) is between about 1-3 mm; or between about 1-2.5 mm; or between about 1-2 mm; or between about 1-1.5 mm; or between about 2-3 mm; or between about 2-2.5 mm; or between about 2.5-3 mm; and/or the height of the one or more ribs (H in FIG. 2) is between about 10-110 mm; or between about 10-100 mm; between about 10-75 mm; or between about 10-70 mm; or between about 10-60 mm; or between about 10-50 mm; or between about 10-40 mm; or between about 10-30 mm; or between about 20-110 mm; or between about 20-75 mm; or between about 20-70 mm; or between about 20-60 mm; or between about 20-50 mm; or between about 20-40 mm; or between about 20-30 mm; or between about 30-110 mm; or between about 30-75 mm; or between about 30-70 mm; or between about 30-60 mm; or between about 30-50 mm; or between about 30-40 mm; or between about 40-110 mm; or between about 40-75 mm; or between about 40-70 mm; or between about 40-60 mm; or between about 40-50 mm; or between about 50-110 mm; or between about 50-75 mm; or between about 50-70 mm; or between about 50-60 mm; or between about 60-110 mm; or between about 60-75 mm; or between about 70-110 mm; or between about 70-80 mm; and/or the pitch between the two or more ribs (P in FIG. 2) is between about 40-200 mm; or between about 40-150 mm; or between about 40-140 mm; or between about 40-130 mm; or between about 40-120 mm; or between about 40-110 mm; or between about 40-100 mm; or between about 40-80 mm; or between about 40-70 mm; or between about 60-200 mm; or between about 60-150 mm; or between about 60-140 mm; or between about 60-130 mm; or between about 60-120 mm; or between about 60-110 mm; or between about 60-100 mm; or between about 60-80 mm; or between about 80-200 mm; or between about 80-150 mm; or between about 80-100 mm; or between about 100-200 mm; or between about 100-150 mm; or between about 100-140 mm; or between about 100-130 mm; or between about 100-120 mm; or between about 125-200 mm; or between about 125-150 mm; or between about 125-140 mm; or between about 130-150 mm; or between about 75-120 mm.

Figure 4:
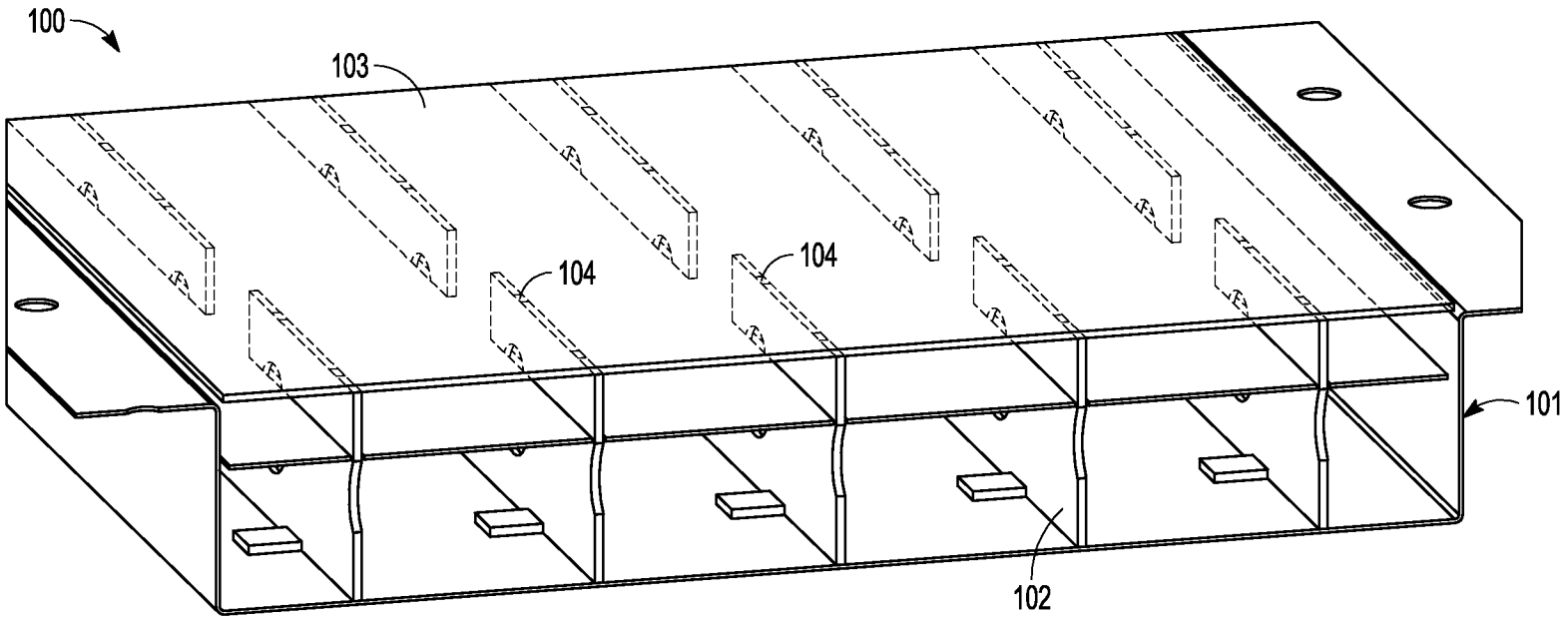
FIG. 4 illustrates some embodiments related to a cross-sectional and an enlarged view of the anode pan assembly or the cathode pan assembly comprising one or more ribs, an electrode and one or more welds welding the electrode to the ribs.

As shown in FIG. 1, the electrode 103 is welded to the top of the one or more ribs 102. Also illustrated in FIG. 4 is the electrode 103 welded to the ribs 102 through welds 104. In some embodiments, the electrode is a planar electrode or an expanded metal or a mesh. In embodiments where the electrode is an expanded metal or a mesh, the thickness of each strand is between about 0.5-3 mm; or between about 0.5-2.5 mm; or between about 0.5-2 mm; or between about 0.5-1.5 mm; or between about 0.5-1 mm; or between about 1-3 mm; or between about 1-2.5 mm; or between about 1-2 mm; or between about 1-1.5 mm; or between about 1.5-3 mm; or between about 1.5-2.5 mm; or between about 1.5-2 mm; or between about 2-3 mm; or between about 2.5-3 mm.

The geometry, spacing or density, and/or cross sectional area of the welds impact current flow through the half-cell. As the operational current density is increased and even more current flows through the cell, the density or spacing and the cross sectional area of the welds can significantly impact the local Joule heating and can be employed to avoid the membrane damage due to local hot spots. The welds in FIG. 4 are illustrated as spots. However, the welds can be in form of lines, spots, pattern, or any other shape, or combinations thereof. For example, the spot welders can create spots and laser welders can produce lines, and/or spots and/or patterns. The patterns include, e.g. combination of dots, array of dots, dashes, spots, lines, line segments, rectangular geometry, circular geometry, hexagonal geometry etc.

Various examples of welding techniques include, without limitation, laser welding, TiG welding and spot welding. Laser welding may enable a single linear weld along the whole length of the one or more ribs welding the ribs to the electrode. For example, when the one or more ribs are a solid plate or a plate with holes (with no notches), there may be a single linear weld along the whole length of the rib welding the rib to the electrode. Laser welding (or TiG) may also be used to create welds in the form of line segments. For example, when the one or more ribs are a solid plate with notches or a plate with holes and notches, there may be segments of weld lines over the ridges of the ribs (but not the notches) along the whole length of the rib welding the rib to the electrode. Laser welding can also produce weld patterns comprising dots, an array of dots, dashes, spots, line segments, long lines, oval geometry, rectangular geometry, circular geometry, hexagonal geometry, or combinations thereof. The weld geometries may be dictated by the shape of the welding tip and anvil. TiG welds may be created manually and they can be in arbitrary form.

In some embodiments, the geometry of the welds includes the number of welds in the anode and/or the cathode pan. In some embodiments, the number of the welds welding the electrode to the ribs in the anode and/or the cathode pan can impact the current distribution and the power dissipation. In some embodiments, the number of the one or more welds per rib that are in the form of the spots is between about 10-50 welds per rib; or between about 10-40 welds per rib; or between about 10-30 welds per rib; or between about 10-20 welds per rib; or between about 20-50 welds per rib; or between about 20-40 welds per rib; or between about 20-30 welds per rib; or between about 30-40 welds per rib; or between about 35-40 welds per rib; or between about 40-50 welds per rib.

In some embodiments, the distance between the welds when two or more welds are in the form of the spots is between about 25-200 mm independently in x- and y-directions. In some embodiments, the distance between the welds when two or more welds are in the form of the spots is between about 25-200 mm; or between about 25-150 mm; or between about 25-100 mm; or between about 25-75 mm; or between about 25-50 mm; or between about 50-200 mm; or between about 50-150 mm; or between about 50-100 mm; or between about 50-75 mm; or between about 75-200 mm; or between about 75-150 mm; or between about 75-100 mm; or between about 100-200 mm; or between about 100-150 mm, independently in x- and y-directions.

In some embodiments, any of the numbers of the spot welds provided above can be combined with the distance between each of the two or more spot welds provided above.

In some embodiments, the number of the one or more welds per rib that are in the form of the lines is between about 1-75 welds per rib; or between about 1-70 welds per rib; or between about 1-60 welds per rib; or between about 1-50 welds per rib; or between about 1-40 welds per rib; or between about 1-30 welds per rib; or between about 1-20 welds per rib; or between about 1-10 welds per rib; or between about 2-75 welds per rib; or between about 2-70 welds per rib; or between about 2-60 welds per rib; or between about 2-50 welds per rib; or between about 2-40 welds per rib; or between about 2-30 welds per rib; or between about 2-20 welds per rib; or between about 2-10 welds per rib; or between about 10-75 welds per rib; or between about 10-70 welds per rib; or between about 10-60 welds per rib; or between about 10-50 welds per rib; or between about 10-40 welds per rib; or between about 10-30 welds per rib; or between about 10-20 welds per rib; or between about 25-75 welds per rib; or between about 25-50 welds per rib; or between about 50-75 welds per rib; or between about 60-75 welds per rib.

In some embodiments, the distance between the welds when two or more welds are in the form of the lines is between about 40-200 mm independently in x- and y-directions. In some embodiments, the distance between the welds when two or more welds are in the form of the lines is between about 40-200 mm; or between about 40-150 mm; or between about 40-100 mm; or between about 40-75 mm; or between about 75-200 mm; or between about 75-150 mm; or between about 75-100 mm; or between about 100-200 mm; or between about 100-150 mm; or between about 150-200 mm, independently in x- and y-directions.

In some embodiments, when the one or more ribs comprise one or more notches and one or more ridges, the welds comprise one or more line segments that weld the electrode to the ridges of the one or more ribs. In some embodiments, the aforementioned line segment welds the electrode to the entire length of the ridge or partial length of the ridge of the one or more ribs. In some embodiments, the length of the line segment weld is the length of the ridge or length of the line segment weld is between about 0.25-1.0 m; or between about 0.25-0.8 m; or between about 0.25-0.6 m; or between about 0.25-0.5 m; or between about 0.25-0.4 m; or between about 0.25-0.3 m; or between about 0.5-1.0 m; or between about 0.5-0.8 m; or between about 0.5-0.6 m; or between about 0.6-1.0 m; or between about 0.6-0.8 m; or between about 0.7-1.0 m; or between about 0.7-0.8 m; or between about 0.8-1.0 m.

In some embodiments, the distance between the two line segment welds is between about 5-100 mm; or between about 5-80 mm; or between about 5-60 mm; or between about 5-50 mm; or between about 5-40 mm; or between about 5-30 mm; or between about 5-20 mm; or between about 5-10 mm; or between about 10-100 mm; or between about 10-50 mm; or between about 10-40 mm; or between about 10-30 mm; or between about 10-20 mm; or between about 20-100 mm; or between about 20-50 mm; or between about 20-40 mm; or between about 20-30 mm; or between about 30-100 mm; or between about 30-50 mm; or between about 30-40 mm; or between about 40-100 mm; or between about 40-50 mm; or between about 50-100 mm; or between about 75-100 mm.

In some embodiments, any of the numbers of the line welds provided above can be combined with the distance between each of the line welds provided above.

In some embodiments, when the weld is a pattern, the pattern is selected from the group consisting of dots, an array of dots, dashes, spots, line segments, long lines, oval geometry, rectangular geometry, circular geometry, hexagonal geometry, and combinations thereof. In some embodiments, the cross sectional area of each weld is between about 6 $mm^2$-3300 $mm^2$; or between about 6 $mm^2$-3000 $mm^2$; or between about 6 $mm^2$-2000 $mm^2$; or between about 6 $mm^2$-1000 $mm^2$; or between about 6 $mm^2$-500 $mm^2$; or between about 6 $mm^2$-300 $mm^2$; or between about 6 $mm^2$-100 $mm^2$; or between about 50 $mm^2$-3300 $mm^2$; or between about 50 $mm^2$-3000 $mm^2$; or between about 50 $mm^2$-2000 $mm^2$; or between about 50 $mm^2$-1000 $mm^2$; or between about 50 $mm^2$-500 $mm^2$; or between about 50 $mm^2$-300 $mm^2$; or between about 50 $mm^2$-100 $mm^2$; or between about 100 $mm^2$-3300 $mm^2$; or between about 100 $mm^2$-3000 $mm^2$; or between about 100 $mm^2$-2000 $mm^2$; or between about 100 $mm^2$-1000 $mm^2$; or between about 100 $mm^2$-500 $mm^2$; or between about 100 $mm^2$-300 $mm^2$; or between about 500 $mm^2$-3300 $mm^2$; or between about 500 $mm^2$-3000 $mm^2$; or between about 500 $mm^2$-2000 $mm^2$; or between about 500 $mm^2$-1000 $mm^2$; or between about 1000 $mm^2$-3300 $mm^2$; or between about 1000 $mm^2$-3000 $mm^2$; or between about 1000 $mm^2$-2000 $mm^2$; or between about 2000 $mm^2$-3000 $mm^2$; or between about 2500 $mm^2$-3000 $mm^2$.

In some embodiments, the geometry, spacing or density, and/or cross sectional area of the welds is such that ratio of electrode area to weld area is in range of 15× to 2000×; or 15× to 1000×; or 15× to 500×.

In some embodiments, the geometry, spacing or density, and/or cross sectional area of the welds is such that the current density through each weld is less than 6 $A/mm^2$; or less than 5 $A/mm^2$; or less than 4 $A/mm^2$; or less than 3 $A/mm^2$; or less than 2 $A/mm^2$; or less than 1 $A/mm^2$; or between about 1-6 $A/mm^2$; or between about 1-4 $A/mm^2$.

In some embodiments, the number of the one or more welds per rib that are in the form of the spots is between about 10-50 welds per rib; distance between the welds when two or more welds are in the form of the spots is between about 25-200 mm independently in x- and y-directions; the cross sectional area of each weld is between about 6 $mm^2$-3300 $mm^2$; and/or the current density through each weld is less than 6 $A/mm^2$ or less than 4 $A/mm^2$.

In some embodiments, the number of the one or more welds per rib that are in the form of the lines is between about 1-75 welds per rib; distance between the welds when two or more welds are in the form of the lines is between about 40-200 mm independently in x- and y-directions; the cross sectional area of each line weld is between about 6 $mm^2$-3300 $mm^2$; and/or the current density through each weld is less than 6 $A/mm^2$ or less than 4 $A/mm^2$.

In some embodiments, the electrochemical cell comprising the anode and/or the cathode pan assembly disclosed herein, operates at high current densities of between about 300 $mA/cm^2$-6000 $mA/cm^2$; or between about 300 $mA/cm^2$-5000 $mA/cm^2$; or between about 300 $mA/cm^2$-4000 $mA/cm^2$; or between about 300 $mA/cm^2$-3000 $mA/cm^2$; or between about 300 $mA/cm^2$-2000 $mA/cm^2$; or between about 300 $mA/cm^2$-1000 $mA/cm^2$; or between about 300 $mA/cm^2$-800 $mA/cm^2$; or between about 300 $mA/cm^2$-600 $mA/cm^2$; or between about 300 $mA/cm^2$-500 $mA/cm^2$; or between about 500 $mA/cm^2$-6000 $mA/cm^2$; or between about 500 $mA/cm^2$-5000 $mA/cm^2$; or between about 500 $mA/cm^2$-4000 $mA/cm^2$; or between about 500 $mA/cm^2$-3000 $mA/cm^2$; or between about 500 $mA/cm^2$-2000 $mA/cm^2$; or between about 500 $mA/cm^2$-1000 $mA/cm^2$; or between about 500 $mA/cm^2$-800 $mA/cm^2$; or between about 500 $mA/cm^2$-600 $mA/cm^2$; or between about 600 $mA/cm^2$-6000 $mA/cm^2$; or between about 600 $mA/cm^2$-5000 $mA/cm^2$; or between about 600 $mA/cm^2$-4000 $mA/cm^2$; or between about 600 $mA/cm^2$-3000 $mA/cm^2$; or between about 600 $mA/cm^2$-2000 $mA/cm^2$; or between about 600 $mA/cm^2$-1000 $mA/cm^2$; or between about 600 $mA/cm^2$-800 $mA/cm^2$; or between about 800 $mA/cm^2$-6000 $mA/cm^2$; or between about 800 $mA/cm^2$-5000 $mA/cm^2$; or between about 800 $mA/cm^2$-4000 $mA/cm^2$; or between about 800 $mA/cm^2$-3000 $mA/cm^2$; or between about 800 $mA/cm^2$-2000 $mA/cm^2$; or between about 800 $mA/cm^2$-1000 $mA/cm^2$; or between about 1000 $mA/cm^2$-6000 $mA/cm^2$; or between about 1000 $mA/cm^2$-5000 $mA/cm^2$; or between about 1000 $mA/cm^2$-4000 $mA/cm^2$; or between about 1000 $mA/cm^2$-3000 $mA/cm^2$; or between about 1000 $mA/cm^2$-2000 $mA/cm^2$; or between about 2000 $mA/cm^2$-6000 $mA/cm^2$; or between about 2000 $mA/cm^2$-5000 $mA/cm^2$; or between about 2000 $mA/cm^2$-4000 $mA/cm^2$; or between about 2000 $mA/cm^2$-3000 $mA/cm^2$; or between about 3000 $mA/cm^2$-6000 $mA/cm^2$; or between about 3000 $mA/cm^2$-5000 $mA/cm^2$; or between about 3000 $mA/cm^2$-4000 $mA/cm^2$; or between about 4000 $mA/cm^2$-6000 $mA/cm^2$; or between about 5000 $mA/cm^2$-6000 $mA/cm^2$. In some embodiments, the electrochemical cell comprising the anode and/or the cathode pan assembly disclosed herein, operates at high current densities of between about 300 $mA/cm^2$-3000 $mA/cm^2$; or between about 300 $mA/cm^2$-2000 $mA/cm^2$; or between about 300 $mA/cm^2$-1000 $mA/cm^2$; or between about 300 $mA/cm^2$-800 $mA/cm^2$; or between about 300 $mA/cm^2$-600 $mA/cm^2$; or between about 300 $mA/cm^2$-500 $mA/cm^2$; or between about 300 $mA/cm^2$-400 $mA/cm^2$.

In some embodiments, the anode and/or the cathode pan assembly comprises a high flow rate of anolyte or catholyte, respectively, of between about 200-10,000 kg/h; or between about 200-9000 kg/h; or between about 200-8000 kg/h; or between about 200-7000 kg/h; or between about 200-6000 kg/h; or between about 200-5000 kg/h; or between about 200-4000 kg/h; or between about 200-3000 kg/h; or between about 200-2000 kg/h; or between about 200-1000 kg/h; or between about 500-10,000 kg/h; or between about 500-9000 kg/h; or between about 500-8000 kg/h; or between about 500-7000 kg/h; or between about 500-6000 kg/h; or between about 500-5000 kg/h; or between about 500-4000 kg/h; or between about 500-3000 kg/h; or between about 500-2000 kg/h; or between about 500-1000 kg/h; or between about 800-10,000 kg/h; or between about 800-9000 kg/h; or between about 800-8000 kg/h; or between about 800-7000 kg/h; or between about 800-6000 kg/h; or between about 800-5000 kg/h; or between about 800-4000 kg/h; or between about 800-3000 kg/h; or between about 800-2000 kg/h; or between about 800-1000 kg/h; or between about 1000-10,000 kg/h; or between about 1000-9000 kg/h; or between about 1000-8000 kg/h; or between about 1000-7000 kg/h; or between about 1000-6000 kg/h; or between about 1000-5000 kg/h; or between about 1000-4000 kg/h; or between about 1000-3000 kg/h; or between about 1000-2000 kg/h; or between about 3000-10,000 kg/h; or between about 3000-9000 kg/h; or between about 3000-8000 kg/h; or between about 3000-7000 kg/h; or between about 3000-6000 kg/h; or between about 3000-5000 kg/h; or between about 5000-10,000 kg/h; or between about 5000-8000 kg/h; or between about 5000-6000 kg/h; or between about 6000-10,000 kg/h; or between about 6000-8000 kg/h; or between about 8000-10,000 kg/h. Examples of the anolyte and/or catholyte include water or water with alkali, such as for example alkali metal hydroxide e.g. NaOH or KOH in water.

In some embodiments, the superficial liquid velocity of the anolyte and/or the catholyte through the anode and/or the cathode pan assembly is less than 0.1 m/s or less than 0.08 m/s or less than 0.05 m/s or less than 0.01 m/s.

In some embodiments, the anode and/or the cathode pan assembly provided herein is inside a hydrogen gas producing electrochemical cell.

Accordingly, in one aspect, there is provided an electrochemical cell, such as e.g. a hydrogen gas producing electrochemical cell, comprising: an anode pan assembly comprising an anode pan; one or more ribs wherein the one or more ribs are positioned vertically inside the anode pan; an anode welded to the one or more ribs; and one or more welds that weld the anode to the one or more ribs. In some embodiments of the aforementioned aspect, the electrochemical cell further comprises a cathode positioned on a cathode pan assembly; and an ion exchange membrane disposed between the anode and the cathode.

The cathode pan assembly in the aforementioned aspect may be any conventional cathode pan assembly.

Various dimensions of the geometry and spacing of the one or more ribs and/or the welds and/or the location and the placement of the components have all been described herein and can be applied to the aforementioned aspect.

In one aspect, there is provided an electrochemical cell, such as e.g. a hydrogen gas producing electrochemical cell, comprising: a cathode pan assembly comprising a cathode pan; one or more ribs wherein the one or more ribs are positioned vertically inside the cathode pan; a cathode welded to the one or more ribs; and one or more welds that weld the cathode to the one or more ribs. In some embodiments of the aforementioned aspect, the electrochemical cell further comprises an anode positioned on an anode pan assembly and an ion exchange membrane disposed between the anode and the cathode.

The anode pan assembly in the aforementioned aspect may be any conventional anode pan assembly. Various dimensions of the geometry and spacing of the one or more ribs and/or the welds and/or the location and the placement of the components have all been described herein and can be applied to the aforementioned aspect.

In one aspect, there is provided an electrochemical cell, such as e.g. a hydrogen gas producing electrochemical cell, comprising:

- an anode pan assembly comprising an anode pan; one or more ribs wherein the one or more ribs are positioned vertically inside the anode pan; an electrode welded to the one or more ribs; and one or more welds that weld the electrode to the one or more ribs;
- a cathode pan assembly comprising a cathode pan; one or more ribs wherein the one or more ribs are positioned vertically inside the cathode pan; an electrode welded to the one or more ribs; and one or more welds that weld the electrode to the one or more ribs; and
- an ion exchange membrane disposed between the anode and the cathode.

In some embodiments, there is provided an electrolyzer comprising multiplicity of aforementioned aspects of individual electrochemical cells.

The components of the anode and/or cathode pan assembly may be made from an electro conductive material such as, but not limited to, nickel, stainless steel, stainless steel alloys, and the like. The anode and the cathode pans may be made of a conductive metal. The conductive metal includes any conductive metal suitable to be used as an anode pan or the cathode pan. For example, in some embodiments, the anode pan in the anode pan assembly or the cathode pan in the cathode pan assembly is made of a conductive metal such as, but not limited to, nickel, stainless steel, stainless steel alloys, and the like.

The electrolyzer may comprise a single cell or a stack of cells connected in series or in parallel. The electrolyzer may be a stack of 5 or 6 or 50 or 100 or more electrochemical cells connected in series or in parallel. Each cell comprises the anode and/or the cathode pan assembly described herein, an anode, a cathode, and an ion exchange membrane.

In some embodiments, the electrolyzers provided herein are monopolar electrolyzers. In the monopolar electrolyzers, the electrodes may be connected in parallel where all anodes and all cathodes are connected in parallel. In some embodiments, the electrolyzers provided herein are bipolar electrolyzers. In the bipolar electrolyzers, the electrodes may be connected in series where all anodes and all cathodes are connected in series. In some embodiments, the electrolyzers are a combination of monopolar and bipolar electrolyzers and may be called hybrid electrolyzers.

In some embodiments of the bipolar electrolyzers as described above, the cells are stacked serially constituting the overall electrolyzer and are electrically connected in two ways. In bipolar electrolyzers, a single plate, called bipolar plate, may serve as base plate for both the cathode and anode. The electrolyte solution may be hydraulically connected through common manifolds and collectors internal to the cell stack. The stack may be compressed externally to seal all frames and plates against each other which are typically referred to as a filter press design. In some embodiments, the bipolar electrolyzer may also be designed as a series of cells, individually sealed, and electrically connected through back-to-back contact, typically known as a single element design. The single element design may also be connected in parallel in which case it would be a monopolar electrolyzer.

In some embodiments, the cell size may be denoted by the active area dimensions. In some embodiments, the active area of the electrolyzers used herein may range from 0.5-1.5 meters tall and 0.25-3 meters wide. The individual compartment thicknesses may range from 10 mm-100 mm.

Examples of electrocatalysts have been described herein and include, but not limited to, highly dispersed metals or alloys of the platinum group metals, such as platinum, palladium, ruthenium, rhodium, iridium, or their combinations such as platinum-rhodium, platinum-ruthenium, or nickel mesh coated with $RuO_2$. The electrodes may be coated with electrocatalysts using processes well known in the art.

In some embodiments, the ion exchange membrane is an anion exchange membrane (for alkaline conditions) or a cation exchange membrane (for acidic conditions). In some embodiments, the cation exchange membranes in the electrochemical cell, as disclosed herein, are conventional and are available from, for example, Asahi Kasei of Tokyo, Japan; or from Membrane International of Glen Rock, NJ, or Chemours, in the USA. Examples of CEM include, but are not limited to, N2030WX (Chemours), F8020/F8080, and F6801 (Aciplex). CEMs that are desirable in the methods and systems herein may have minimal resistance loss, greater than 90% selectivity, and high stability. For example only, a fully quarternized amine containing polymer may be used as an AEM.

Examples of cationic exchange membranes include, but not limited to, cationic membrane consisting of a perfluorinated polymer containing anionic groups, for example sulphonic and/or carboxylic groups. However, it may be appreciated that in some embodiments, depending on the need to restrict or allow migration of a specific cation or an anion species between the electrolytes, a cation exchange membrane that is more restrictive and thus allows migration of one species of cations while restricting the migration of another species of cations may be used. Similarly, in some embodiments, depending on the need to restrict or allow migration of a specific anion species between the electrolytes, an anion exchange membrane that is more restrictive and thus allows migration of one species of anions while restricting the migration of another species of anions may be used. Such restrictive cation exchange membranes and anion exchange membranes are commercially available and can be selected by one ordinarily skilled in the art.

In some embodiments, the membranes may be selected such that they can function in an acidic and/or alkaline electrolytic solution as appropriate. Other desirable characteristics of the membranes include high ion selectivity, low ionic resistance, high burst strength, and high stability in electrolytic solution in a temperature range of room temperature to 150° C. or higher.

In some embodiments, a membrane that is stable in the range of 0° C. to 150° C.; 0° C. to 100° C.; 0° C. to 90° C.; or 0° C. to 80° C.; or 0° C. to 70° C.; or 0° C. to 60° C.; or 0° C. to 50° C.; or 0° C. to 40° C., or 0° C. to 30° C., or higher may be used. For other embodiments, it may be useful to utilize an ion-specific ion exchange membranes that allows migration of one type of ion (cation with CEM, anion with AEM) but not another; or migration of one type of anion and not another, to achieve a desired product or products in an electrolyte.

The ohmic resistance of the membranes may affect the voltage drop across the anode and the cathode, e.g., as the ohmic resistance of the membranes increase, the voltage across the anode and cathode may increase, and vice versa. Membranes that can be used include, but are not limited to, membranes with relatively low ohmic resistance and relatively high ionic mobility; and membranes with relatively high hydration characteristics that increase with temperatures, and thus decreasing the ohmic resistance. By selecting membranes with lower ohmic resistance known in the art, the voltage drop across the anode and the cathode at a specified temperature can be lowered.

The voltage may be applied to the electrochemical cell by any means for applying the current across the anode and the cathode of the electrochemical cell. Such means are well known in the art and include, without limitation, devices, such as, electrical power source, fuel cell, device powered by sun light, device powered by wind, and combination thereof. The type of electrical power source to provide the current can be any power source known to one skilled in the art. For example, in some embodiments, the voltage may be applied by connecting the anodes and the cathodes of the cell to an external direct current (DC) power source. The power source can be an alternating current (AC) rectified into DC. The DC power source may have an adjustable voltage and current to apply a requisite amount of the voltage to the electrochemical cell.

Methods

In some aspects, there are provided methods to make, manufacture, and/or use the anode and/or the cathode pan assembly provided herein.

In one aspect, there is provided a method, comprising positioning one or more ribs vertically inside an anode and/or a cathode pan of an electrochemical cell; positioning an electrode on top of the one or more ribs; and welding the electrode to the one or more ribs through one or more welds. The thickness of the one or more ribs, the height of the one or more ribs, the pitch between the one or more ribs, the number of the welds per rib, the distance between each weld, the cross sectional area of each weld, and/or ratio of electrode area to weld area; that minimize the impact of fluctuating power dissipation on internal temperature of the cell and prevent membrane erosion and/or fatigue, have all been provided herein.

In some embodiments of the aforementioned aspects, the method further comprises placing the electrode perpendicularly to the one or more ribs. In some embodiments of the aforementioned aspects and embodiments, the method further comprises providing thickness of the one or more ribs to be between about 1-3 mm; height of the one or more ribs to be between about 10-110 mm; and/or pitch between two or more ribs to be between about 40-200 mm. In some embodiments of the aforementioned aspects and embodiments, each of the one or more ribs comprises one or more notches and one or more ridges. In some embodiments of the aforementioned aspects and embodiments, the electrode is a planar electrode or an expanded metal or a mesh.

In some embodiments of the aforementioned aspects and embodiments, the method further comprises providing each strand of the expanded metal or the mesh electrode having a thickness of between about 0.5-3 mm. In some embodiments of the aforementioned aspects and embodiments, the method further comprises providing the one or more welds in form of lines, spots, pattern, or combinations thereof. In some embodiments of the aspects and embodiments provided herein, the method further comprises providing number of the one or more welds per rib that are in the form of the spots to be between about 10-50 welds per rib.

In some embodiments of the aspects and embodiments provided herein, the method further comprises providing distance between the welds when two or more welds are in the form of the spots to be between about 25-200 mm independently in x- and y-directions.

In some embodiments of the aspects and embodiments provided herein, the method further comprises providing number of the one or more welds per rib that are in the form of the lines is between about 1-75 welds per rib.

In some embodiments of the aspects and embodiments provided herein, the method further comprises providing distance between the welds when two or more welds are in the form of the lines to be between about 40-200 mm independently in x- and y-directions.

In some embodiments of the aspects and embodiments provided herein, the method further comprises providing cross sectional area of each weld to be between about 6 $mm^2$-3300 $mm^2$.

In some embodiments of the aspects and embodiments provided herein, the method further comprises providing ratio of electrode area to weld area in range of 15× to 2000×.

In some embodiments of the aspects and embodiments provided herein, the one or more ribs are metallurgically attached to the anode and/or the cathode pan. The "metallurgical" or grammatical equivalent thereof, used herein includes any metallurgical technique to attach an element to the pan and/or the electrochemical cell. Such techniques include, without limitation, diffusion bonding, soldering, welding, cladding e.g. laser cladding, brazing, and the like.

In some embodiments of the aspects and embodiments provided herein, the method further comprises operating the anode and/or the cathode pan assembly provided herein under a high flow rate of anolyte or catholyte, respectively, of between about 200-10,000 kg/h. The high flow rates of the anolyte and/or catholyte have been provided herein.

In some embodiments of the aspects and embodiments provided herein, the method further comprises positioning the anode and/or the cathode pan assembly provided herein to assemble an electrochemical cell and operating the electrochemical cell at high current densities of between about 300 $mA/cm^2$-6000 $mA/cm^2$. Various rages of the high current densities for operating the electrochemical cell have been provided herein.

In some embodiments of the foregoing aspects and embodiments, the electrochemical cell is hydrogen gas producing cell. The gas flowing through the one or more ribs and the electrode in the anode assembly or the cathode assembly is oxygen gas and hydrogen gas, respectively.

In some embodiments of the foregoing aspects and embodiments, the method further comprises minimizing impact of fluctuating power dissipation on internal temperature of the cell. In some embodiments of the foregoing aspects and embodiments, the method further comprises ensuring superficial liquid velocity of anolyte and/or catholyte through the one or more ribs to be less than 0.1 m/s or less than 0.08 m/s or less than 0.05 m/s. In some embodiments of the foregoing aspects and embodiments, the method further comprises accommodating high flow rate of anolyte or catholyte and/or gas. The high flow rates of the anolyte and/or catholyte through the anode and cathode have been exemplified herein. In some embodiments of the foregoing aspects and embodiments, the method further comprises preventing pressure fluctuations to less than 0.5 psi or less than 0.4 psi or less than 0.3 psi or less than 0.2 psi or less than 0.1 psi. In some embodiments of the foregoing aspects and embodiments, the method further comprises preventing membrane damage due to local hot spots, erosion and/or fatigue.

In one aspect, there is provided a process for manufacturing the anode and/or the cathode pan assembly, comprising: positioning one or more ribs vertically inside an anode and/or a cathode pan of an electrochemical cell; positioning an electrode on top of the one or more ribs; and welding the electrode to the one or more ribs through one or more welds. The thickness of the one or more ribs, the height of the one or more ribs, the pitch between the one or more ribs, the number of the welds per rib, the distance between each weld, the cross sectional area of each weld, and/or ratio of electrode area to weld area; that minimize the impact of fluctuating power dissipation on internal temperature of the cell and prevent membrane damage due to local hot spots, erosion and/or fatigue, have all been provided herein.

In some embodiments of the foregoing aspect, the process comprising metallurgically attaching the one or more ribs inside the anode and/or the cathode pan of the electrochemical cell. In some embodiments of the foregoing aspect, the process comprising metallurgically attaching the one or more ribs inside the anode and/or the cathode pan of the electrochemical cell and metallurgically attaching the baffle plate over the one or more ribs.

In one aspect, there is provided a process for assembling an electrochemical cell, comprising:

assembling an individual electrochemical cell by joining together the anode pan assembly described herein with a conventional cathode pan assembly comprising a cathode pan and a cathode;

placing the anode pan assembly and the cathode pan assembly in parallel and separating them by an ion-exchange membrane; and supplying the electrochemical cell with feeders for a cell current and an electrolysis feedstock.

In one aspect, there is provided a process for assembling an electrochemical cell, comprising:

assembling an individual electrochemical cell by joining together the cathode pan assembly described herein with a conventional anode pan assembly comprising an anode pan and an anode;

placing the anode pan assembly and the cathode pan assembly in parallel and separating them by an ion-exchange membrane; and supplying the electrochemical cell with feeders for a cell current and an electrolysis feedstock.

In one aspect, there is provided a process for assembling an electrochemical cell, comprising:

assembling an individual electrochemical cell by joining together the anode pan assembly described herein and the cathode pan assembly described herein;

placing the anode pan assembly and the cathode pan assembly in parallel and separating them by an ion-exchange membrane; and supplying the electrochemical cell with feeders for a cell current and an electrolysis feedstock.

In some embodiments of the aforementioned aspects, the electrochemical cell is hydrogen gas producing cell. The gas flowing through the one or more ribs and/or the electrode in the anode pan assembly or the cathode pan assembly is oxygen gas and hydrogen gas, respectively.

In one aspect, there is provided a process for assembling an electrolyzer, comprising: assembling aforementioned individual electrochemical cells; and placing a plurality of the assembled electrochemical cells side by side in a stack and bracing them together so as to sustain electrical contact between the electrochemical cells.

The following examples are put forth so as to provide those of ordinary skill in the art with a disclosure and description of how to make and/or use the present invention, and are not intended to limit the scope of what the inventors regard as their invention nor are they intended to represent that the experiments below are all or the only experiments performed. Various modifications of the invention in addition to those described herein will become apparent to those skilled in the art from the foregoing description and accompanying figures. Such modifications fall within the scope of the appended claims. Efforts have been made to ensure accuracy with respect to numbers used (e.g. amounts, temperature, etc.) but some experimental errors and deviations should be accounted for. Unless indicated otherwise, parts are parts by weight, molecular weight is weight average molecular weight, temperature is in degrees Centigrade, and pressure is at or near atmospheric.

In the examples and elsewhere, abbreviations have the following meanings:

| | |
|---|---|
| IEM = | ion exchange membrane |
| kgh = | kilogram per hour |
| $mA/cm^2$ = | milliamps/centimeter square |
| m = | meter |
| mm = | millimeter |
| $mm^2$ = | millimeter square |
| m/s = | meter/sec |
| psi = | per square inch |

EXAMPLES

Example 1

Current and Temperature Distribution Through Weld

Figure 5A:
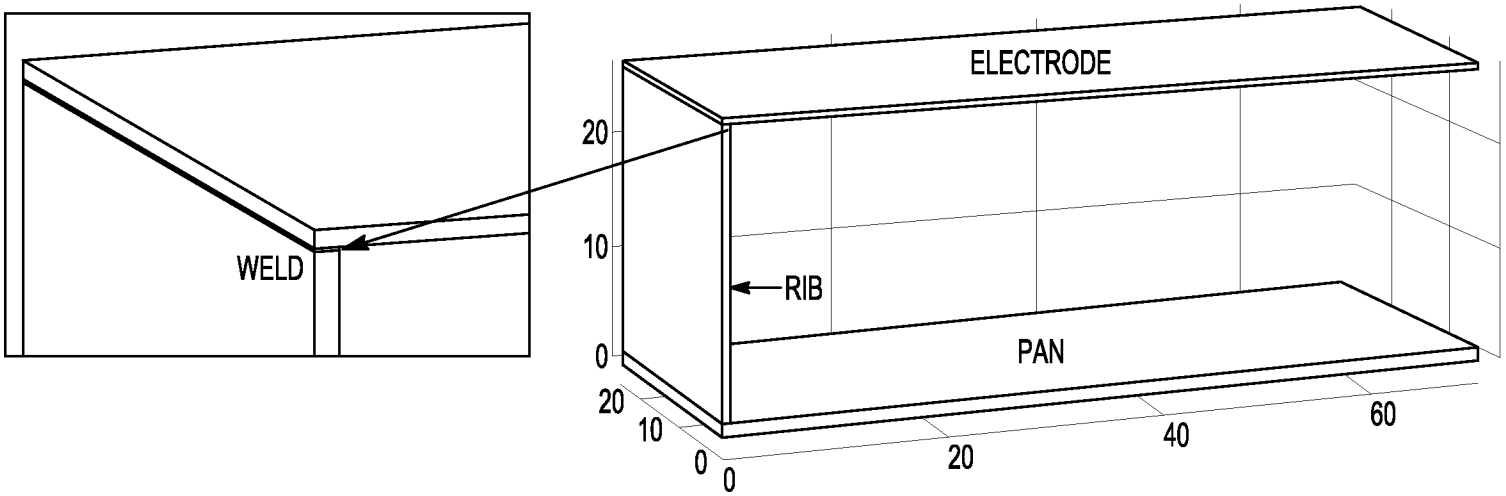
FIGS. 5A and 5B illustrate simulated model of a section of an electrode welded to a rib that is welded to a pan.
Figure 5B:
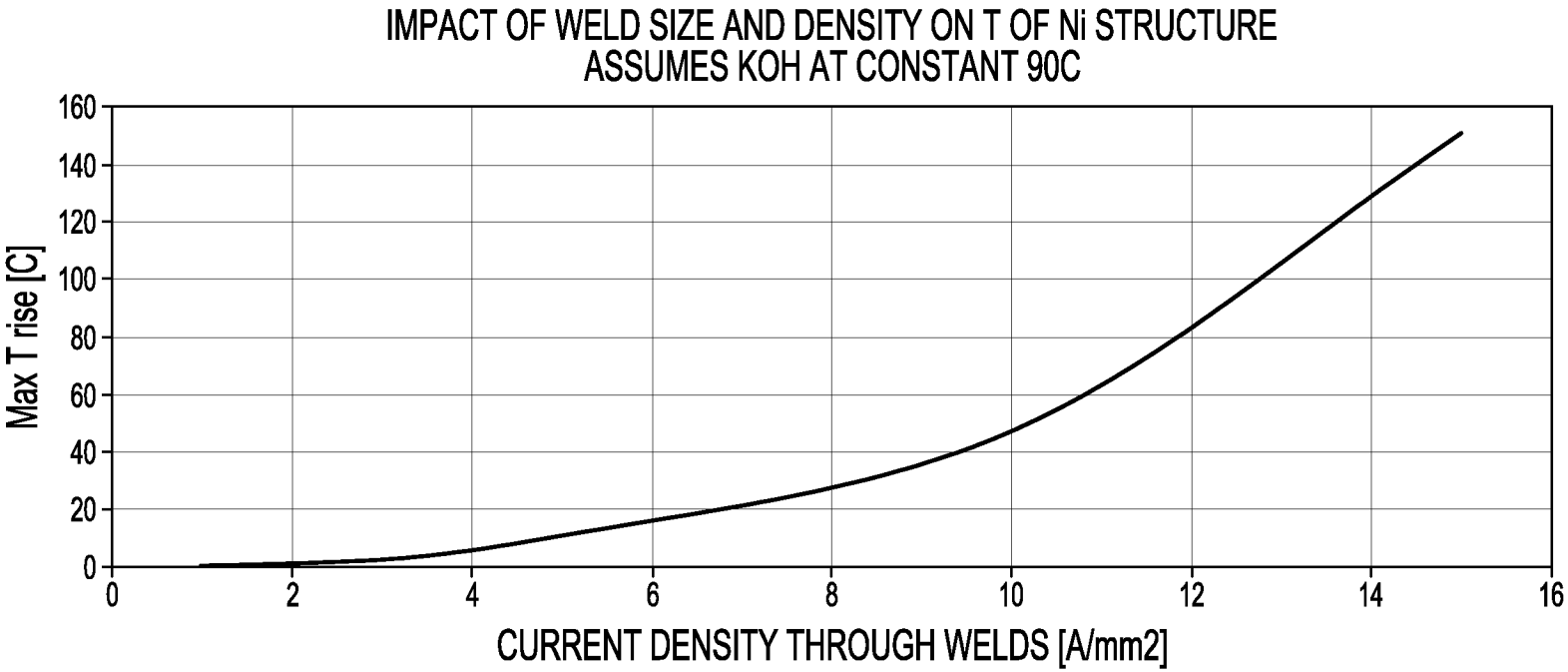

FIGS. 5A and 5B demonstrate a simulation of joule heating within an electrochemical cell. FIG. 5A is an illustration of the modeled structure, which includes a section of an electrode that is welded to a rib that is welded to a pan (all components are Ni). A normal current density was assigned to the electrode and the pan was assumed to be at ground potential. A convective heat transfer coefficient (100 $W/m^2 \cdot K$) was assigned to the internal surfaces, and the temperature of the internal fluid (KOH) was assigned 90° C. The temperature distribution through the modeled structure was calculated as a function of the current density applied to the electrode. The corresponding range of current densities through the weld was calculated. Finally, the maximum temperature was plotted (FIG. 5B) as a function of the current density through the weld. As is evident from FIG. 5B, the maximum temperature increased rapidly as the current density through the weld increased. Since the current density through the weld increases as the ratio of the electrode area feeding that weld to that weld's cross-sectional area increases (corresponding to relatively fewer and/or smaller welds across the active area), it is evident that the weld density and geometry have a significant impact on the temperature distribution within a cell operating at a high current density.

What is claimed is:

1. An electrochemical cell, comprising:

a first pan assembly comprising;

a first pan configured to receive a first electrolyte flowing through the first pan having a first pan floor;

a plurality of first ribs positioned vertically inside the first pan, wherein each of the first ribs comprises a first rib end attached to the first pan floor and a second rib end spaced from the first pan floor;

a first planar metal body having a first planar face and an opposing second planar face; and a plurality of first welds that weld the first planar face of the first planar metal body to the second rib ends of the plurality of first ribs, wherein the plurality of the first welds form a first distributed array across the first planar face of the first planar metal body and the second rib ends of the plurality of first ribs; and a second pan assembly comprising a second pan configured to receive a second electrolyte flowing through the second pan and a second planar metal body, wherein the second pan assembly is positioned proximate to the first pan assembly;

a separator disposed between the first planar metal body of the first pan assembly and the second planar metal body of the second pan assembly;

and a power supply configured to apply a current density of at least 1000 $mA/cm^2$ to the electrochemical cell;

wherein a rib geometry of the plurality of first ribs and a number, size, and positions of the plurality of the first welds are such that current is distributed across the first planar metal body such that an impact of power dissipation on a first temperature rise of the first planar metal body is reduced to reduce or prevent damage to the separator when the electrochemical cell is operated at a current density of at least 1000 $mA/cm^2$, wherein the rib geometry of the plurality of first ribs includes a thickness of each of the plurality of first ribs of from about 1 mm to about 2 mm and a pitch between first ribs of from about 40 mm to about 200 mm.

2. The electrochemical cell of claim 1, wherein the separator is an ion exchange membrane.

3. The electrochemical cell of claim 1, wherein the rib geometry includes a height of each of the plurality of first ribs of from about 20 mm to about 100 mm.

4. The electrochemical cell of claim 1, wherein the first planar metal body is an anode of the electrochemical cell and the second planar metal body is a cathode of the electrochemical cell.

5. The electrochemical cell of claim 1, wherein one or both of the first and second planar metal bodies comprise an expanded metal body or a mesh.

6. The electrochemical cell of claim 1, wherein each of the plurality of first welds is in a form of a line, a spot, a pattern, or a combination thereof.

7. The electrochemical cell of claim 1, wherein a distance between adjacent first welds is from about 25 mm to about 200 mm independently in an x-direction and a y-direction.

8. The electrochemical cell of claim 1, wherein the electrochemical cell is a hydrogen gas producing electrochemical cell.

9. A method, comprising:

providing an electrochemical cell comprising a first pan assembly and a second pan assembly, and a separator disposed between the first pan assembly and the second pan assembly;

wherein the first pan assembly comprises a first pan having a first pan floor, a plurality of first ribs disposed inside the first pan, each of the first ribs comprising a first rib end attached to the first pan floor and a second rib end spaced from the first pan floor, a first planar metal body having a first planar face and an opposing second planar face, and a plurality of first welds coupling the first planar face of the first planar metal body to the second rib ends of the plurality of first ribs, wherein a rib geometry of the plurality of first ribs and a number, size, and positions of the plurality of the first welds are such that an impact of power dissipation on a first temperature rise of the first planar metal body is reduced to reduce or prevent damage to the separator, wherein the rib geometry of the plurality of first ribs includes a thickness of each of the plurality of first ribs of from about 1 mm to about 2 mm and a pitch between first ribs of from about 40 mm to about 200 mm, wherein the second pan assembly comprises a second pan and a second planar metal body, wherein the second pan assembly is positioned proximate to the first pan assembly, and wherein the separator is disposed between the first planar body of the first pan assembly and the second planar metal body of the second pan assembly;

flowing a first electrolyte through the first pan;

flowing a second electrolyte through the second pan; and passing a current between the first planar metal body and the second planar metal body at a current density of at least 1000 $mA/cm^2$;

wherein the current passes between the first planar metal body and the plurality of first ribs via the plurality of the first welds to distribute the current across the first planar metal body.

10. The method of claim 9, wherein the plurality of first welds form a distributed array across the first planar metal body and the second rib ends of the plurality of first ribs.

11. The method of claim 9, wherein the separator is an ion exchange membrane.

12. The method of claim 9, wherein a flow rate of the first electrolyte through the first pan is from about 200 kg/h to about 10,000 kg/h.

13. The method of claim 9, further comprising adjusting the electrochemical cell to operate at a second current density within a current density range of from about 300 $mA/cm^2$ to about 6000 $mA/cm^2$.

14. The method of claim 9, further comprising generating hydrogen gas in the first pan assembly.

15. The method of claim 9, further comprising:

positioning the plurality of first ribs each having a first rib end and a second rib end vertically inside the first pan of an electrochemical cell so that the first rib ends of the plurality of first ribs are proximate to the first pan floor of the first pan and so that the second rib ends of the plurality of first ribs are spaced from the first pan floor, wherein each of the plurality of first ribs have a rib geometry comprising a thickness of from about 1 mm to about 2 mm, and wherein the plurality of first ribs are positioned so that a pitch between the first ribs is from about 40 mm to about 200 mm;

attaching the first rib end of each of the plurality of first ribs to the first pan floor of the first pan;

positioning the first planar metal body having a first planar face and a second planar face on top of the second rib ends of the plurality of first ribs so that the first planar face of the first planar metal body is on the second rib ends of the plurality of first ribs;

welding the first planar face of the first planar metal body to the second rib ends of the plurality of first ribs with a plurality of first welds; and positioning the first pan proximate to the second pan comprising the second planar metal body;

wherein the plurality of the first welds form a first distributed array across the first planar metal body such that the plurality of the first welds distribute current across the first-planar metal body, wherein the rib geometry of the plurality of first ribs and a number, size, and positions of the plurality of first welds are such that an impact of power dissipation on a first temperature rise of the first planar metal body is reduced to reduce or prevent damage to the separator when the electrochemical cell is operated at a current density of at least 1000 $mA/cm^2$.

16. The method of claim 15, wherein the first planar metal body is an anode of the electrochemical cell and the second planar metal body is a cathode of the electrochemical cell.

17. The method of claim 15, wherein one or both of the first and second planar metal bodies comprise an expanded metal body or a mesh.

18. The method of claim 15, wherein each of the plurality of the first welds is in a form of a line, a spot, a pattern, or a combination thereof.

19. The method of claim 15, wherein the electrochemical cell is a hydrogen gas producing electrochemical cell.

20. The electrochemical cell of claim 1, wherein the second pan comprises a second pan floor, wherein the second planar metal body comprises a first planar face and an opposing second planar face, wherein the second pan assembly further comprises a plurality of second ribs positioned vertically inside the second pan, wherein each of the second ribs comprises a first rib end attached to the second pan floor and a second rib end spaced from the second pan floor, and a plurality of second welds that weld the first planar face of the second planar metal body to the second rib ends of the plurality of second ribs, wherein the plurality of the second welds form a second distributed array across the second planar metal body and the second rib ends of the plurality of second ribs, and wherein a rib geometry of the plurality of second ribs and a number, size, and positions of the plurality of the second welds are such that current is distributed across the second planar metal body such that an impact of power dissipation on a second temperature rise of the second planar metal body is reduced to reduce or prevent damage to the separator when the electrochemical cell is operated at the current density of at least 1000 $mA/cm^2$, wherein the rib geometry of the plurality of second ribs includes a thickness of each of the plurality of second ribs of from about 1 mm to about 2 mm and a pitch between second ribs of from about 40 mm to about 200 mm.

21. The method of claim 9, wherein the second pan comprises a second pan floor, wherein the second planar metal body comprises a first planar face and an opposing second planar face, wherein the second pan assembly further comprises a plurality of second ribs positioned vertically inside the second pan, wherein each of the second ribs comprises a first rib end attached to the second floor and a second rib end spaced form the second floor, and a plurality of second welds coupling the first planar face of the second planar metal body to the second rib ends of the plurality of second ribs, wherein a rib geometry of the plurality of second ribs and a number, size, and positions of the plurality of the second welds are such that an impact of power dissipation on a second temperature rise of the second planar metal body is reduced to reduce or prevent damage to the separator, wherein the rib geometry of the plurality of second ribs includes a thickness of each of the plurality of second ribs of from about 1 mm to about 2 mm and a pitch between first ribs of from about 40 mm to about 200 mm, passing current between the second planar metal body and the plurality of second ribs via the plurality of the second welds to distribute the current across the second planar metal body.

22. The method of claim 15, wherein the second pan comprises a second pan floor and wherein the second planar metal body comprises a first planar face and an opposing second planar face, the method further comprising:

positioning a plurality of second ribs each having a first rib end and a second rib end vertically inside the second pan so that the first rib ends of the plurality of first ribs are proximate to the second pan floor of the second pan and so that the second rib ends of the plurality of second ribs are spaced from the second pan floor, wherein each of the plurality of second ribs has a rib geometry comprising a thickness of from about 1 mm to about 2 mm and wherein the plurality of second ribs are positioned so that a pitch between the second ribs is from about 40 mm to about 200 mm;

attaching the second rib end of each of the plurality of second ribs to the second pan floor of the second pan positioning the second planar metal body on top of the second rib ends of the plurality of second ribs so that the first planar face of the second planar metal body is on the second rib ends of the plurality of second ribs; and welding the first planar face of the second planar metal body to the second rib ends of the plurality of second ribs with the plurality of second welds, wherein the plurality of the second welds form a second distributed array across the second planar metal body such that the plurality of the second welds distribute current across the second planar metal body, wherein the rib geometry of the plurality of second ribs and a number, size, and positions of the plurality of second welds are such that an impact of power dissipation on a second temperature rise of the second planar metal body is reduced to reduce or prevent damage to the separator when the electrochemical cell is operated at the current density of 1000 $mA/cm^2$.

23. The electrochemical cell of claim 1, wherein the first planar metal body is perpendicular to each of the plurality of first ribs.

24. The method of claim 9, wherein the first planar metal body is perpendicular to each of the plurality of first ribs.

25. The method of claim 9, wherein the rib geometry includes a height of each of the plurality of first ribs of from about 20 mm to about 100 mm.

26. The method of claim 9, wherein the first planar metal body is an anode of the electrochemical cell and the second planar metal body is a cathode of the electrochemical cell.

27. The method of claim 9, wherein one or both of the first and second planar metal bodies comprise an expanded metal body or a mesh.

28. The method of claim 15, wherein the first planar metal body is perpendicular to each of the plurality of first ribs after positioning the first planar metal body on the second rib ends of the plurality of first ribs.

29. The method of claim 15, wherein the rib geometry includes a height of each of the plurality of first ribs of from about 20 mm to about 100 mm.

* * * * *